US007603986B2

(12) United States Patent
Ricco et al.

(10) Patent No.: US 7,603,986 B2
(45) Date of Patent: Oct. 20, 2009

(54) FUEL ADJUSTMENT AND FILTERING DEVICE FOR A HIGH-PRESSURE PUMP

(75) Inventors: Mario Ricco, Casamassima (IT); Raffaele Ricco, Valenzano (IT); Sergio Stucchi, Valenzano (IT); Onofrio De Michele, Valenzano (IT); Domenico Lepore, Valenzano (IT); Marcello Gargano, Valenzano (IT)

(73) Assignee: C.R.f Societa Consortio per Azioni, Strada Turin (IT)

( * ) Notice: Subject to any disclaimer, the term of this patent is extended or adjusted under 35 U.S.C. 154(b) by 339 days.

(21) Appl. No.: 11/650,530

(22) Filed: Jan. 5, 2007

(65) Prior Publication Data

US 2008/0116300 A1 May 22, 2008

(30) Foreign Application Priority Data

Nov. 16, 2006 (EP) ..... 06425782

(51) Int. Cl.
*F02M 69/54* (2006.01)
*F02M 69/52* (2006.01)

(52) U.S. Cl. ..... 123/457; 123/458

(58) Field of Classification Search ..... 123/509, 123/514, 508, 506, 457, 458, 495, 459, 456, 123/447; 210/338
See application file for complete search history.

(56) References Cited

U.S. PATENT DOCUMENTS 3,516,395 A * 6/1970 Bassot et al. ..... 123/472
3,628,024 A * 12/1971 Ciemochowski ..... 250/215
3,762,379 A * 10/1973 Hobo et al. ..... 123/447
6,142,120 A * 11/2000 Biester et al. ..... 123/456
6,253,734 B1 7/2001 Rembold et al.
7,380,541 B1 * 6/2008 Ricco et al. ..... 123/447
2001/0004889 A1 * 6/2001 Schreckenberger ..... 123/457
2001/0008147 A1 7/2001 Miller et al.
2003/0136384 A1 * 7/2003 Linden et al. ..... 123/458
2004/0173188 A1 * 9/2004 Braun ..... 123/509
2007/0039865 A1 * 2/2007 Jiang et al. ..... 210/259

FOREIGN PATENT DOCUMENTS

DE 19834120 A1 2/2000
EP 0148374 A2 7/1985
EP 0658362 A2 6/1995
EP 1124054 A2 8/2001
WO WO 2004/020816 A1 3/2004

* cited by examiner

*Primary Examiner*—Mahmoud Gimie
(74) *Attorney, Agent, or Firm*—RatnerPrestia

(57) ABSTRACT

A fuel adjustment and filtering device for a high-pressure pump of a fuel injection system, the device comprising at least one filter, comprising a removable filter cartridge, comprising a filtering body, housed within a filter casing; a shut-off solenoid valve for metering fuel; and, a pressure control valve for the fuel. The solenoid valve and pressure control valve are housed in a block separate from the pump. In one embodiment, in which the pressure control valve is optional, the solenoid valve may be mounted on the filter casing.

28 Claims, 3 Drawing Sheets

FUEL ADJUSTMENT AND FILTERING DEVICE FOR A HIGH-PRESSURE PUMP

CROSS REFERENCE TO RELATED APPLICATIONS

This application claims priority to European Patent Application No.: 06425782.7 filed on Nov. 16, 2006, incorporated herein by reference.

BACKGROUND OF THE INVENTION

The present invention relates to a fuel adjustment and filtering device for a high-pressure pump in an injection system for an internal combustion engine.

As it is known, fuel injection systems of internal combustion engines typically comprise a low-pressure fuel pump to take the fuel from the usual tank and send it to the high-pressure pump. This sends the pressurised fuel to a common rail connected to the various engine cylinder injectors. The system further comprises a fuel filter and devices for controlling the rail fuel pressure.

Injection systems are known wherein the high-pressure pump is of the variable flow rate type, and is controlled to avoid pumping excess fuel in respect to what is required by the injectors, thus reducing the work performed by the high-pressure pump and therefore increasing the engine efficiency. In a known system, the high-pressure pump flow rate is metered by a shut-off solenoid valve, arranged on the intake pipe of the pump and controlled by a control unit, according to the operative conditions of the engine.

It has also been proposed to insert, in the intake pipe of the high-pressure pump, a control valve adapted to adjust the pressure of the fuel, upstream of the shut-off solenoid valve, to a predetermined value. This valve sends the excess fuel received from the low-pressure pump, to the high-pressure pump, from where it is discharged into the fuel tank. The excess fuel lubricates and cools the operating mechanism of such pump before returning to the tank. Furthermore, in order to avoid load losses and hydraulic resonance waves between the two pumps, the shut-off solenoid valve and the pressure control valve of the fuel to intake must be reciprocally arranged as close as possible.

In the high-pressure pumps of the known art, in general the fuel filter is arranged between the low-pressure pump and the high-pressure pump. Furthermore, the shut-off solenoid valve and the pressure control valve are integrated with the high-pressure pump and are accommodated in a common casing, which comprises the high-pressure crankcase, thus forming the pump body in which the various pumping elements are housed. Such an integration however creates a considerable complexity in the hydraulic connection of the adjustment valve and of the shut-off valve. The pump body therefore appears relatively heavy and cumbersome, thus requiring a complicated and costly manufacture.

For automobile engines, in which the injection system must be assembled within the usual engine housing, it also appears difficult to find space for such high-pressure pump near the usual common rail on the engine head. Finally, as it is known, the shut-off solenoid valve comprises some delicate electrical components, some plastic electrical connectors, and some other parts more fragile than the pump body, which is generally formed by cast iron. The solenoid valve can be subjected to damage both during assembly on the engine and in the case of automobile collisions or accidents, endangering its operation. In the case of automobile accident, a dangerous leakage of fuel may further be generated.

The present invention relates to providing a fuel adjustment and filtering device for a high-pressure pump of an injection system, which is easy to manufacture and to assemble and of low cost, eliminating the drawbacks of the devices of the known art.

SUMMARY OF THE INVENTION

One embodiment of the invention comprises an adjustment and filtering device for a high-pressure pump in an injection system for an internal combustion engine, in which the device comprises at least one filter, a shut-off solenoid valve for metering filtered fuel from the filter to the pump, and a pressure control valve for the filtered fuel, wherein the shut-off solenoid valve and the pressure control valve are located in a block separate from said pump. The filter comprises a filter casing and a filter cartridge housed within the casing, and the filter cartridge comprises a filtering body. The solenoid valve and pressure control valve may be fixed to or integrated with the filter cartridge casing. A union for connection to a fuel supply pipe may be fixed to the casing lid. The block may comprise two unions to connect the solenoid valve and the control valve to the pump, and a group of internal passages to connect the solenoid valve upstream of the valve in the direction of flow of the fuel.

In another embodiment of the invention, the adjustment and filtering device comprises at least one filter, the filter comprising a filter casing and a removable filter cartridge housed within the filter casing, the removable filter cartridge comprising a filtering body, and a shut-off solenoid valve for metering filtered fuel output by said filter to said pump, wherein the shut-off solenoid valve is located in a block fixed on the filter casing.

BRIEF DESCRIPTION OF THE DRAWINGS

For a better understanding of the invention, a preferred embodiment will be described hereinafter by way of example, with the help of the accompanying drawings, in which.

DESCRIPTION OF PREFERRED EMBODIMENTS

Figure 1:
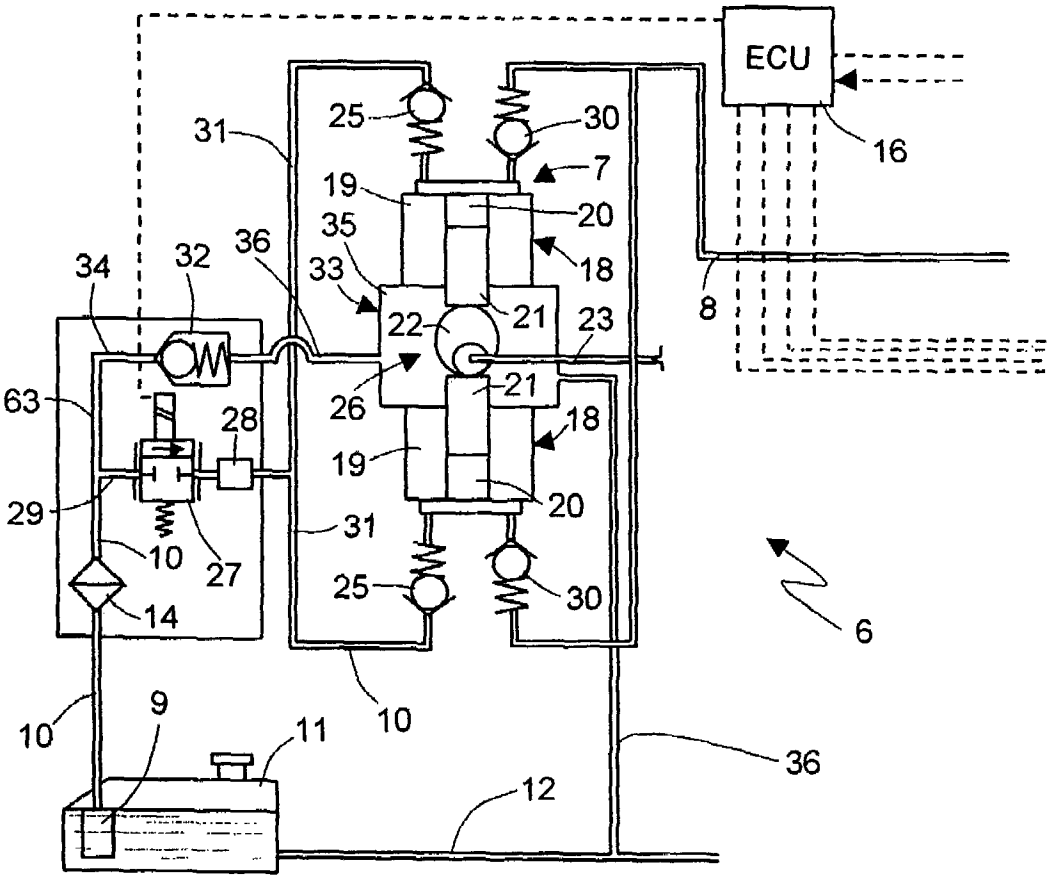
FIG. 1 is a partial schematic diagram of an injection system incorporating an exemplary fuel adjustment and filtering device according to the invention.
Figure 2:
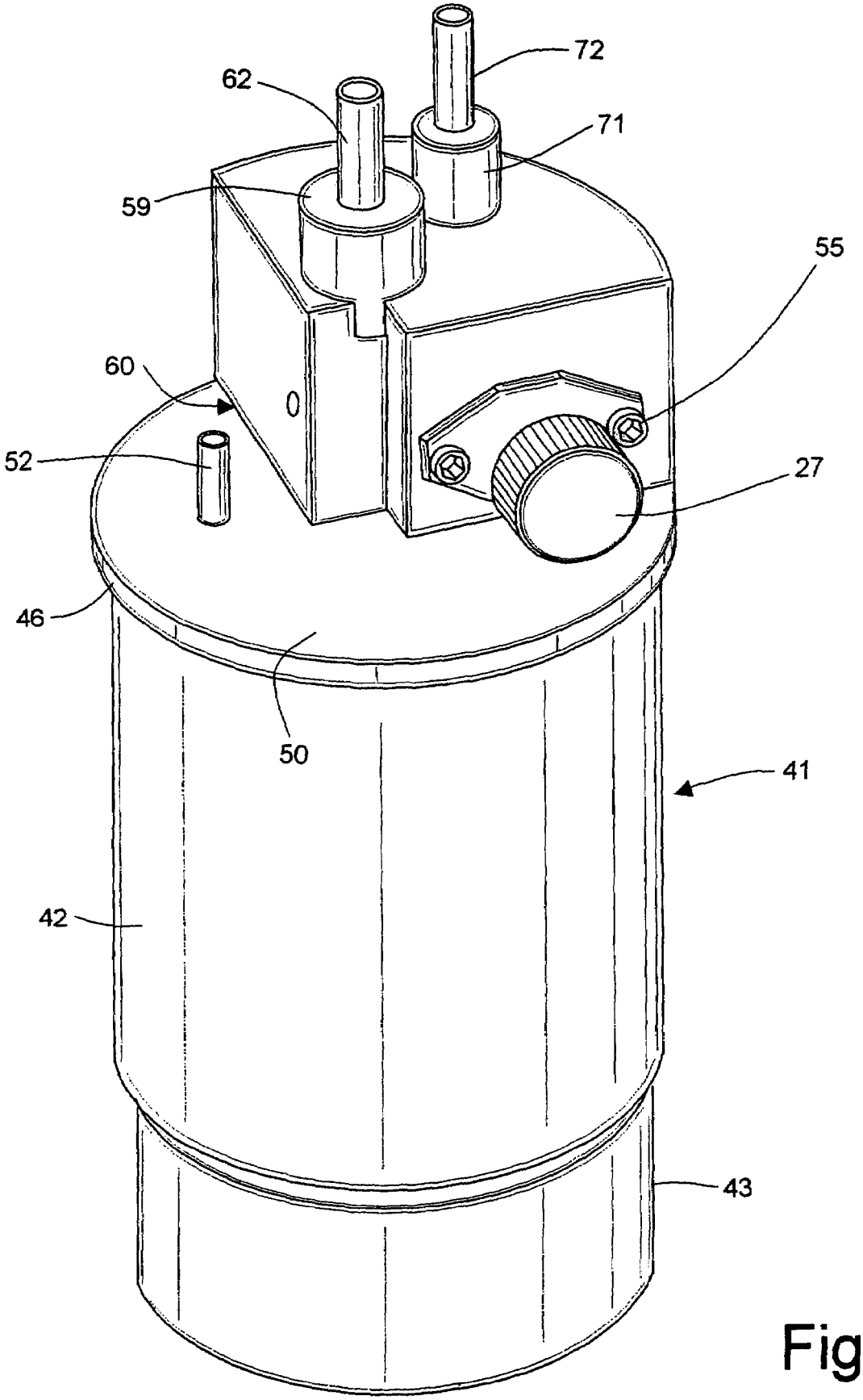
FIG. 2 is a perspective top view of an exemplary adjustment and filtering device.

With reference to FIG. 1, reference number 6 generically indicates a fuel injection system for an internal combustion engine, for example, a four-stroke diesel cycle engine, which typically comprises a plurality of injectors connected to a pressurised fuel common rail (not shown in FIG. 2). The common rail is supplied with high-pressure fuel by a high-pressure pump 7, by means of a delivery pipe 8. In turn, high-pressure pump 7 is supplied by a low-pressure pump, for example a pump 9, by means of a supply pipe 10 of pump 7. Pump 9 is generally arranged in usual fuel tank 11, to which an exhaust pipe 12 of the fuel in excess in injection system 1 leads.

On supply pipe 10 there is arranged a filter 14 adapted to prevent the introduction in pump 7 of possible impurities present in the fuel pumped by low-pressure pump 9. Each injector is adapted to inject each time in the corresponding cylinder a variable quantity of fuel, under the control of an electronic control unit 16, which may be formed by the usual engine microprocessor control unit. Control unit 16 controls both the injectors and the fuel pressure in the common rail by processing signals corresponding to the operative conditions of the engine.

High-pressure pump 7 comprises at least one pumping element 18 formed by cylinder 19 having an intake chamber 20, in which slides piston 21 in reciprocating motion formed by an intake stroke and a delivery stroke. Specifically, in FIG. 1 pump 7 comprises two pumping elements 18, each of which having a compression chamber 20 provided with a corresponding intake valve 25 and a corresponding delivery valve 30. Valves 25 and 30 may be of the ball type and may be provided with respective recall springs. The two intake valves 25 are in communication with reciprocally common supply pipe 10, as described in better detail below, while the two delivery valves 30 are in communication with delivery pipe 8 in common to the latter.

Pistons 21 are operated by an actuating mechanism 26 housed in a compartment 35 enclosed in a crankcase 33. In FIG. 1, the two pumping elements 18 are reciprocally coaxial and opposite, and actuating mechanism 26 comprises a single cam 22 carried by a shaft 23, in consequence of which pistons 21 are actuated with a reciprocal offset of 180°. Shaft 23 may be actuated in any known way, for example by the usual engine crankshaft, by means of a motion transmission device.

The flow rate of high-pressure pump 7 is exclusively controlled by a metering, or shut-off, solenoid valve 27, of the on-off type, which is provided with an inlet 29 in communication with supply pipe 10, and an outlet 28 in communication with intake valves 25, through corresponding intake pipes 31. Solenoid valve 27 is adapted to be actuated, in synchronous or asynchronous manner with respect to the movement of pumping elements 18, both during the intake stroke and during the compression stroke, according to the operative conditions of the engine, by control unit 16, by means of frequency modulated and/or duty cycle control signals. These conditions determine the quantity of fuel that the pump 7 must intake through pipes 31.

On supply pipe 10 is further arranged a pressure control valve 32, which is used to maintain constant the pressure of the fuel to be supplied, continuously pumped by low-pressure pump 9. Specifically, pressure control valve 32 is of the ball and spring type, and is provided with an inlet 34 in communication with supply pipe 10. Valve 32, through an outlet pipe 36, sends the excess fuel in compartment 35 of crankcase 33 of the pump 7, for the purpose of cooling and lubricating actuating mechanism 2. The excess fuel having entered compartment 35 returns to tank 11, through outlet pipe 36 in communication with exhaust pipe 12.

Figure 3:
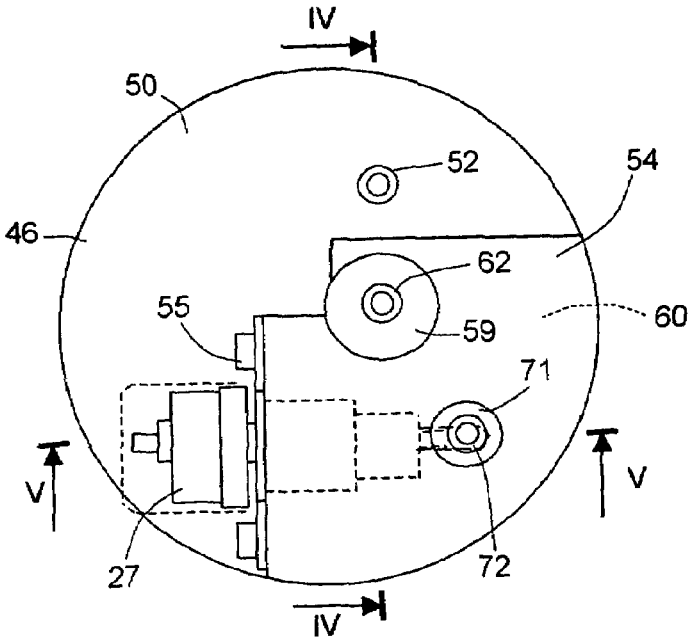
FIG. 3 is a top view of the device of FIG. 2.
Figure 4:
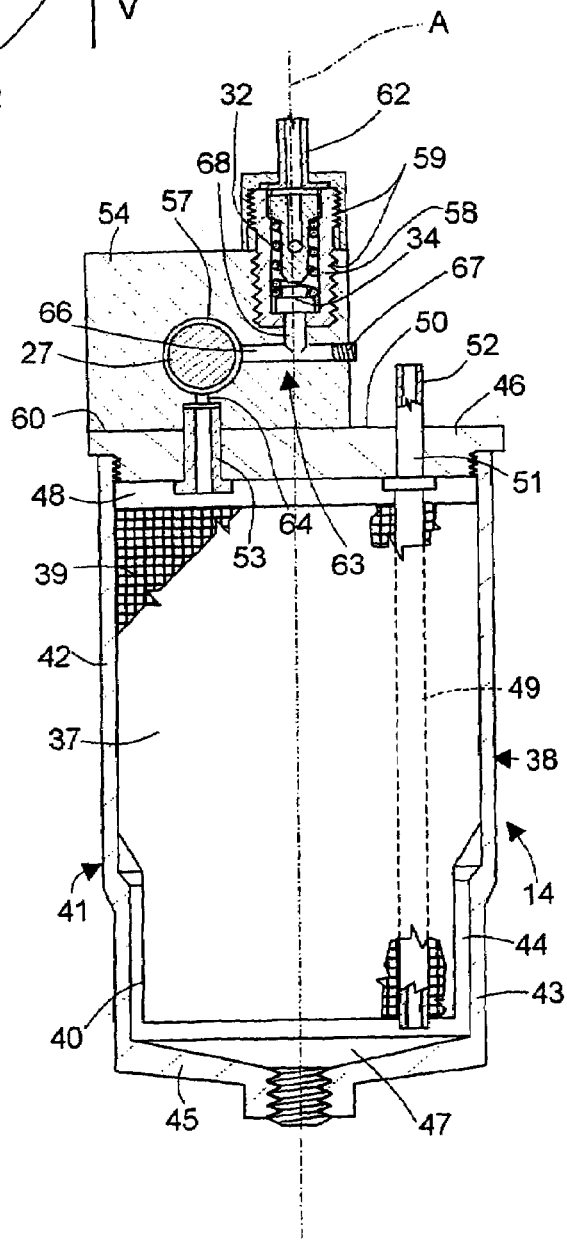
FIG. 4 is a section taken along line IV-IV of FIG. 3.

Filter 14 comprises a filtering body 37 (FIG. 4) comprising materials f known in the art for such purposes, such as for example, paper or felt. Filtering body 37 is accommodated in a metallic material cartridge 38 (FIGS. 2 and 3) formed by a side wall 39, having an essentially cylindrical shape, with a lower portion 40 of reduced diameter, whereby the cartridge 38 is open on both ends.

Filter 14 is adapted to be removably housed in an substantially cylindrical casing 41 independent from the body of pump 7. Casing 41 presents a cylindrical wall 42 having an axis A, which presents a lower portion 43 of reduced diameter, adapted to partially accommodate portion 40 of wall 39 with a large clearance, so as to define a gap 44. Casing 41 is integral with a closed lower wall 45, and is further provided with a flat upper wall or lid 46, removably connected to side wall 42 of casing 41, by any means known in the art, such as for example by bayonet or clip fastening, not shown in the drawings, to allow the replacement of cartridge 38.

Filtering body 37 determines in casing 41 a lower chamber 47 contiguous to gap 44, and an upper chamber 48 delimited by lid 46. It is crossed by a pipe 49 parallel to axis A, which on one side leads to lower chamber 47 and on the other is adapted to fluid-tightly engage a coaxial pipe 51, carried by lid 46. Pipe 51 protrudes from a free portion 50 of lid 46, forming an inlet union 52, which is adapted to be connected to supply pipe 10 (also see FIG. 1). Lid 46 is further crossed by a sleeve 53 parallel to pipe 51, which leads on bottom into upper chamber 48 and protrudes on top from lid 46 itself.

Figure 5:
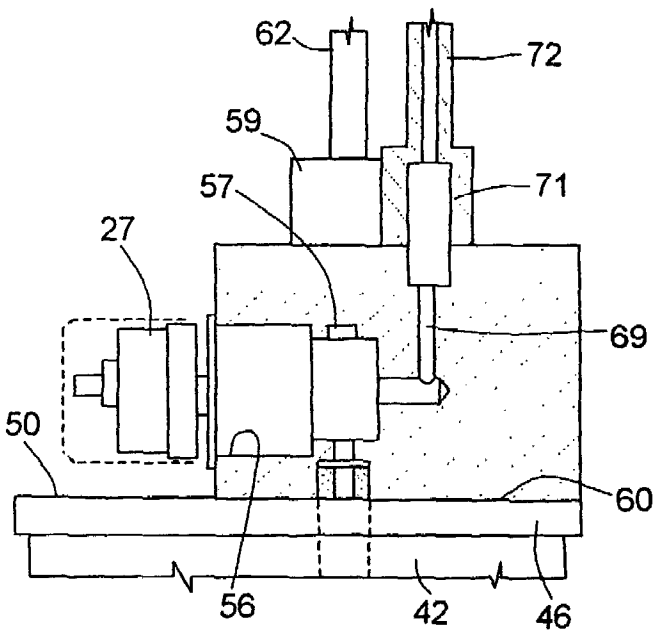
FIG. 5 is a section taken along line V-V of FIG. 3.

Shut-off solenoid valve 27 (FIG. 5) is housed in a cylindrical seat 56 of an substantially prismatic-shaped block 54, fixed in known manner onto lid 46, covering another part 60 of lid 46, and leaving union 52 free. Seat 56 presents an axis perpendicular to axis A and only partially houses solenoid valve 27, so as to allow the electrical connection with control unit 16 and with electrical power. Solenoid valve 27 is removably mounted in block 54, by means of screws 55. Seat 56 forms with the body of solenoid valve 27 an annular chamber 57 in communication with inlet 29 of solenoid valve 27, as will be better seen below. Annular chamber 57 allows the fuel from filtering body 37 to cross the inlet of solenoid valve 27 when this is closed and however ensures a continuous flow rate of fuel towards pressure control valve 32.

Block 54 is further provided with a cylindrical seat 58 (FIG. 4) parallel to axis A and adapted to house at least partially a cylindrical body 59, in which control valve 32 is enclosed. Body 59 carries inlet 34 of valve 32 and an outlet union 62. Union 62 is parallel to axis A and protrudes from block 54. It is adapted to be connected as is known in the art to outlet pipe 36, to send the fuel discharged by valve 32 to compartment 35 of crankcase 33.

Block 54 presents a group of internal pipes, indicated as a whole by number 63, which are adapted to put into communication the outlet of filter 14, represented by sleeve 53, with inlet 29 of solenoid valve 27 and with inlet 34 of valve 32. Specifically, the series of pipes 63 comprises an axial pipe segment 64 which leads into annular chamber 57 of seat 56, and is in fluid-tight communication with sleeve 53. The inlet of solenoid valve 27 is in communication with annular chamber 57, as is known in the art.

Annular chamber 57 is further in communication with a radial pipe 66, closed by a cap 67 for technological reasons. Radial pipe 66 is in communication with the inlet union 34 of valve 32, through another axial pipe 68. Therefore, solenoid valve 27 is arranged, with respect to valve 32, upstream in the direction of flow of the fuel. The segment of the group of pipes 63 comprising annular chamber 57 and pipes 66 and 68 comprised between inlet 29 of solenoid valve 27 and inlet 34 of valve 32 is dimensioned so as to ensure, in use, the flow of fuel at inlet 29 of solenoid valve 27 and, when this is closed, allows the disposal of the entire flow rate of pump 9 towards pressure control valve 32.

Finally, outlet 28 (FIG. 5) of solenoid valve 27 is in communication with an axial pipe 69 of block 54, which leads to a sleeve 71, in which an outlet union 72 parallel to axis A is fluid-tightly inserted. Outlet union 72 is placed in use in communication between intake valves 25 (also see FIG. 1) of pumping elements 18, through intake pipes 31.

The flow of fuel through the adjustment and filtering device is performed as follows.

The fuel pumped by low-pressure pump 9 (FIGS. 1 and 4), as shown above, entirely reaches inlet union 52 and, through pipe 49 of filtering body 37, reaches lower chamber 47 of casing 41. After crossing filtering body 37, the fuel, through sleeve 53, now enters block 54 and reaches annular chamber 57. Since the quantity of fuel pumped by low-pressure pump 9 is always greater than that required at inlet 29 of high-pressure pump 7, the fuel in excess tends to make the pressure in inlet pipe 68 to pressure control valve 32 increase thus making it open. The increase of pressure in pipe 68 is balanced by the spring of pressure valve 32, thus a situation of balance is reached when the pressure in pipe 68 reaches the value corresponding to the preload of the spring. Thus, this fuel reaches chamber 35 of case 33, whereby actuating mechanism 26 of pumping elements 18 is continuously lubricated and cooled.

In turn, shut-off solenoid valve 27 is continuously opened and closed under the control of control unit 16, so as to allow the passage towards pump 7 only of the fuel required by the injectors according to the operative conditions of the engine. However, when solenoid valve 27 is closed not only does the flow of fuel continue in the intersection of inlet 29 with annular chamber 57, but this flow is generally also greater, because in such times all the fuel sent by low-pressure pump 9 is discharged by pressure control valve 32.

When solenoid valve 27 is reopened, there is a certain flow of fuel in the group of pipes 63 and specifically in annular chamber 57, so that the fuel presents a certain kinetic component and readily run-through inlet 29 of solenoid valve 27.

From the above, the advantages of fuel adjustment and filtering device 1 according to the invention with respect to the known art are apparent. Specifically, the body of pump 7 is very simple to manufacture, since the number of internal hydraulic connections is considerably reduced, because all of connections 63 are now transferred to a casing other than the body of the pump. Furthermore, the pump body appears lighter, because it no longer needs to contain appendixes or protrusions for accommodating shut-off solenoid valve 27 and pressure control valve 32.

In any case, a weight reduction of the injection system is obtained, because supporting block 54 of the components of the adjustment device, being arranged on the low-pressure circuit, may be formed by lighter material and with reduced thickness. In turn, the assembly of pump 7 in the engine housing, which must be very close to the pressurised fuel common rail and therefore also to the engine head, is much simplified also in virtue of the reduced dimensions of high-pressure pump 7 itself.

Furthermore, since pressure control valve 32 and shut-off solenoid valve 37 can be arranged in block 54, they are relatively much closer to each other, thus obtaining an optimal operation from the hydraulic point of view, avoiding between them a pressure drop and reducing the pressure waves caused by the actuation of solenoid valve 27. Finally, block 54, also with casing 41, may be arranged in the engine bay in an optimal position to reduce the effects of possible automobile accidents.

It is understood that to the adjustment and filtering device described above various modifications and improvement may be made without departing from the scope of the claims. For example, block 54 may be separate from casing 41 and connected to it by means of a simple pipe. Furthermore, pressure control valve 32 may be omitted and block 54 may contain only solenoid valve 27. Also pressure control valve 32 may be arranged upstream of solenoid valve 27, rather than downstream, as shown in the figures. Finally, in the case of a pump 7 with two pumping elements 18, as in FIG. 1, or three radial pumping elements, block 54 may be provided, for each pumping element 18, with an inlet 29 of a corresponding solenoid valve 27, in communication with a specific outlet pipe 53 from the filter 14.

What is claimed:

1. An adjustment and filtering device for a high-pressure pump in an injection system for an internal combustion engine, the device comprising:

at least one filter, the filter comprising a filter casing and a filter cartridge housed within the casing, the filter cartridge comprising a filtering body;

a shut-off solenoid valve for metering filtered fuel from said filter to said pump; and a pressure control valve located downstream of the filter, wherein the shut-off solenoid valve and the pressure control valve are located in a block separate from said pump.

2. The adjustment and filtering device of claim 1, wherein the block is either fixed or integrated with the filter casing.

3. The adjustment and filtering device of claim 2, wherein the filter casing has an essentially cylindrical shape with a flat lid, and the block is fixed to the flat lid.

4. The adjustment and filtering device of claim 3, wherein the flat lid is removably mounted on the filter casing to allow replacement of the filter cartridge.

5. The adjustment and filtering device of claim 3, wherein the block comprises a substantially prismatic shape and covers only a first portion of the flat lid, further comprising an inlet union of a fuel supply pipe to the cartridge configured on a second portion of said flat lid.

6. The adjustment and filtering device of claim 1, wherein the block comprises a radial seat in which the shut-off solenoid valve is removably seated.

7. The adjustment and filtering of claim 1, wherein the block comprises an axial seat in which the pressure control valve is removably seated.

8. The adjustment and filtering device of claim 3, wherein the block comprises a first outlet union for fuel from the solenoid valve.

9. The adjustment and filtering device of claim 8, wherein the block comprises an inlet union connected to a passage in the flat lid to receive filtered fuel.

10. The adjustment and filtering device of claim 9, wherein the pressure control valve comprises an outlet, the pump comprises an actuating mechanism enclosed in a crankcase, and the pressure control valve outlet is configured to be hydraulically connected to the crankcase to lubricate and cool said actuating mechanism.

11. The adjustment and filtering device of claim 10, wherein the pressure control valve outlet is in hydraulic communication with a second outlet union of said block.

12. The adjustment and filtering device of claim 11, wherein the first and second outlet unions are parallel to said inlet union.

13. The adjustment and filtering device of claim 1, wherein the block contains a group of passages comprising at least one internal passage configured to put an inlet of said pressure control valve into communication with an inlet of said solenoid valve, the inlet of the solenoid valve positioned upstream from said pressure control valve with respect to fuel flow.

14. The adjustment and filtering device of claim 13 in which the block is configured within an engine housing of an automobile, wherein the flat lid is fixed within the engine housing separately from the pump.

15. The adjustment and filtering device of claim 3 in which the block is configured within an engine housing of an automobile, wherein the flat lid is fixed within the engine housing separately from the pump.

16. An adjustment and filtering device for a high-pressure pump in an injection system for an internal combustion engine, the device comprising at least one filter separate from said pump, the filter comprising a filter casing and a removable filter cartridge housed within the filter casing, the removable filter cartridge comprising a filtering body; a shut-off solenoid valve for metering filtered fuel output by said filter to said pump, wherein the shut-off solenoid valve is located downstream of the filter in a block fixed on said filter casing.

17. The adjustment and filtering device of claim 16, wherein the filter casing has an essentially cylindrical shape with a flat lid, and the block is fixed to said flat lid.

18. The adjustment and filtering device of claim 17, wherein the flat lid is removably mounted on the filter casing to allow replacement of the filter cartridge.

19. The adjustment and filtering device of claim 17, wherein the block comprises a substantially prismatic shape and covers a first portion of said flat lid, further comprising an inlet union of a fuel supply pipe to the cartridge configured on a second portion of said flat lid.

20. The adjustment and filtering device of claim 16, wherein the block comprises a radial seat in which the shut-off solenoid valve is removably seated.

21. The adjustment and filtering of claim 16, further comprising a pressure control valve for the filtered fuel, wherein the block comprises an axial seat in which the pressure control valve is removably seated.

22. The adjustment and filtering device of claim 17, wherein the block comprises a first outlet union for fuel from the solenoid valve.

23. The adjustment and filtering device of claim 22, wherein the block comprises an inlet union connected to a passage in the flat lid to receive filtered fuel.

24. The adjustment and filtering device of claim 23, further comprising a pressure control valve for the filtered fuel, wherein the pressure control valve comprises an outlet, the pump comprises an actuating mechanism enclosed in a crankcase, and the pressure control valve outlet is configured to be hydraulically connected to the crankcase to lubricate and cool said actuating mechanism.

25. The adjustment and filtering device of claim 24, wherein the pressure control valve outlet is in hydraulic communication with a second outlet union of said block.

26. The adjustment and filtering device of claim 25, wherein the first and second outlet unions are parallel to said inlet union.

27. The adjustment and filtering device of claim 16, further comprising a pressure control valve for the filtered fuel, wherein the block contains a group of passages comprising at least one internal passage configured to put an inlet of said pressure control valve into communication with an inlet of said solenoid valve, the inlet of the solenoid valve positioned upstream from said pressure control valve with respect to fuel flow.

28. The adjustment and filtering device of claim 17 in which the block is configured within an engine housing of an automobile, wherein the flat lid is fixed within the engine housing separately from the pump.

* * * * *

UNITED STATES PATENT AND TRADEMARK OFFICE

CERTIFICATE OF CORRECTION

PATENT NO. : 7,603,986 B2
APPLICATION NO. : 11/650530
DATED : October 20, 2009
INVENTOR(S) : Mario Ricco et al.

It is certified that error appears in the above-identified patent and that said Letters Patent is hereby corrected as shown below:

On the title page at item (73), "C.R.f. Societa Consortio per Azioni," should read, -- C.R.F. Società Consortile per Azioni --.

On the title page at item (73), delete "Strada Turin," insert -- Orbassano --.

Signed and Sealed this
Third Day of December, 2013

Margaret A. Focarino

Margaret A. Focarino
*Commissioner for Patents of the United States Patent and Trademark Office*